US007021216B1

(12) United States Patent
Dragne et al.

(10) Patent No.: US 7,021,216 B1
(45) Date of Patent: Apr. 4, 2006

(54) METHOD OF AND SYSTEM FOR CONTROLLING A BLASTING NETWORK

(75) Inventors: Livia Dragne, Randburg (ZA); Vivian Edward Patz, Kensington (ZA); Christian Hoogenboezem, Kempton Park (ZA)

(73) Assignee: Orica Explosives Technology Pty. Ltd., Melbourne (AU)

( * ) Notice: Subject to any disclaimer, the term of this patent is extended or adjusted under 35 U.S.C. 154(b) by 0 days.

(21) Appl. No.: 10/009,157

(22) PCT Filed: Apr. 20, 2000

(86) PCT No.: PCT/AU00/00351

§ 371 (c)(1),
(2), (4) Date: Apr. 1, 2002

(87) PCT Pub. No.: WO00/63636

PCT Pub. Date: Oct. 26, 2000

(30) Foreign Application Priority Data

Apr. 20, 1999 (ZA) ..... 99/2823

(51) Int. Cl.
*F42D 1/055* (2006.01)

(52) U.S. Cl. ..... 102/200; 102/206; 102/217

(58) Field of Classification Search ..... 102/200, 102/201, 301, 206, 215, 217
See application file for complete search history.

(56) References Cited

U.S. PATENT DOCUMENTS

| | | | | |
|---|---|---|---|---|
| 4,099,467 | A * | 7/1978 | MacKellar et al. | 102/217 |
| 4,674,047 | A * | 6/1987 | Tyler et al. | 364/423 |
| 5,185,528 | A * | 2/1993 | Gordon | 250/341.1 |
| 5,404,820 | A * | 4/1995 | Hendrix | 102/201 |
| 5,756,924 | A * | 5/1998 | Early | 102/201 |
| 5,773,749 | A * | 6/1998 | Cotton, III et al. | 102/217 |
| 6,006,328 | A | 12/1999 | Drake | 713/200 |
| 6,014,932 | A * | 1/2000 | Mardirossian | 102/200 |
| 6,079,333 | A * | 6/2000 | Manning | 102/215 |
| 6,101,916 | A * | 8/2000 | Panot et al. | 89/1.13 |
| 6,199,483 | B1 * | 3/2001 | Barbiche | 102/201 |
| 6,227,114 | B1 * | 5/2001 | Wu et al. | 102/201 |
| 6,247,408 | B1 * | 6/2001 | Andrejkovies et al. | 102/200 |
| 6,470,801 | B1 * | 10/2002 | Swart et al. | 102/201 |

FOREIGN PATENT DOCUMENTS

| | | | | |
|---|---|---|---|---|
| AU | 59457/96 | | 1/1997 | |
| EP | 0301848 | * | 2/1989 | 102/301 |
| EP | 0611944 | * | 8/1994 | |
| EP | 793 154 A1 | | 9/1997 | |

* cited by examiner

*Primary Examiner*—Peter M. Poon
*Assistant Examiner*—David Parsley
(74) *Attorney, Agent, or Firm*—Greenlee, Winner & Sullivan

(57) ABSTRACT

A method and system for controlling a blasting network (16) for use where spurious command signals may be passed through a blasting controller (12) to the blasting network, for example when the controller is connected to the Internet or Intranet (10). The system includes a firewall (14) whereby the communication link (20) between the controller and the blasting network can be placed in a control mode by a switch (19). In the control mode, any previously designated unsafe message such as a fire command is prevented from reaching the blasting network by, for example, disregarding the unsafe message or scrambling it so that it is no longer unsafe. In an operational mode of the communication link, any scrambled unsafe message may be unscrambled and any unsafe message may be transmitted to the blasting network.

18 Claims, 4 Drawing Sheets

METHOD OF AND SYSTEM FOR CONTROLLING A BLASTING NETWORK

TECHNICAL FIELD

This invention relates generally to a blasting system and is particularly concerned with a method of and system for controlling the operation of a blasting network.

BACKGROUND OF THE INVENTION

For safety reasons a blast controlling system used for remotely controlling a blasting network has traditionally been isolated from other networks at a blasting site eg. at a mine. The data on the blasting system can however be used to monitor productivity, implement stock control and improve mining methods by making blast information available to those who need such information. It is also possible to schedule and initiate blasts from a central control facility through a suitable blast controlling system.

Another possibility which arises particularly due to the fact that computers are being used as top level system controllers for distributed networks of blasters is to make use of a computer network using Internet or Intranet capabilities. There are however inherent risks associated with Internet connections. Chief of these is the risk that a hacker or unauthorised user may penetrate the system and deliberately or inadvertently generate an unsafe or dangerous command which can arm and fire the blasting system. This type of action can have catastrophic results.

SUMMARY OF THE INVENTION

The invention provides a method of controlling a blasting network which includes the steps of designating at least one unsafe message, placing a communication link between a control unit and the network in a control mode in which the communication link is monitored for the unsafe message, in said control mode preventing the unsafe message, when detected, from reaching the blasting network, and placing the communication link in an operational mode in which any previously designated unsafe message is allowed to reach the blasting network, and wherein in both the control mode and the operational mode any message which has not been designated as unsafe is permitted to be transmitted via the communication link.

The invention also provides a system for controlling a blasting network which includes a control unit and a communication link for the network, the communication link being capable of being placed in a control mode and in an operational mode, and a monitoring device for monitoring the communication link for at least one previously designated unsafe message, wherein the communication link in its control mode prevents any detected unsafe message from being transmitted to the blasting network and in its operational mode permits any previously designated unsafe message to be transmitted to the blasting network, and wherein in both its control mode and its operational mode the communication link permits any message which has not designated as unsafe to be transmitted via the communication link.

Further according to the present invention there is provided a blasting system including a control system as described in the immediately preceding paragraph connected to a blasting network.

"Unsafe message", as used herein, is used to designate a message or command which, if received by the blasting network, could result in unwanted or adverse conditions or consequences. For example arm and fire commands, if received by the blasting network at an unwanted time, could cause a blast to be initiated in the presence of personnel and thereby result in death or injury.

Preferably therefore the method of the invention includes the step of designating at least two unsafe messages of which two are respectively equated with arm and fire commands.

In the control mode of the communication link, the or each unsafe message may be prevented from reaching the blasting network simply by ignoring the message and not allowing its onward transmission. Alternatively the or each unsafe message may be scrambled so that it is no longer in an unsafe form.

In the operational mode of the communication link, in which unsafe messages are allowed to be transmitted to the blasting network, any previously scrambled unsafe message may be detected and unscrambled prior to transmitting the unscrambled unsafe message to the blasting network.

The control unit may be capable of generating legal unsafe messages, for example legitimate arm and fire commands, which are transmitted via the communication link in its operational mode. However, unsafe messages may be categorised as legal or illegal. The latter group of messages includes those which are illegally generated, for example those messages which arise from any source other than the control unit connected to the communication link.

BRIEF DESCRIPTION OF THE DRAWINGS

One embodiment of a control method and system according to the invention will now be described by way of example only with reference to the accompanying drawings in which.

DESCRIPTION OF PREFERRED EMBODIMENT

When a blasting system is connected to an Intranet or Internet facility, access is provided to information stored in a data base associated with the blasting system. This information is useful inter alia to managers, personnel involved in stores and production, seismic monitoring installations, logistical control units, etc.

A perceived risk with a connection of the aforementioned kind is that unauthorised users may hack through the network security to tamper with the blasting system which is a safety critical system. An unanticipated system fault may result in the safety of the system being compromised and this may lead to the blasting system being fired prematurely which can cause injury or fatalities.

Modern networks provide high levels of user security but due to the complexities of such systems it is not always possible to carry out a complete exhaustive safety analysis of the control software, operating systems and associated fire walls.

Figure 1:
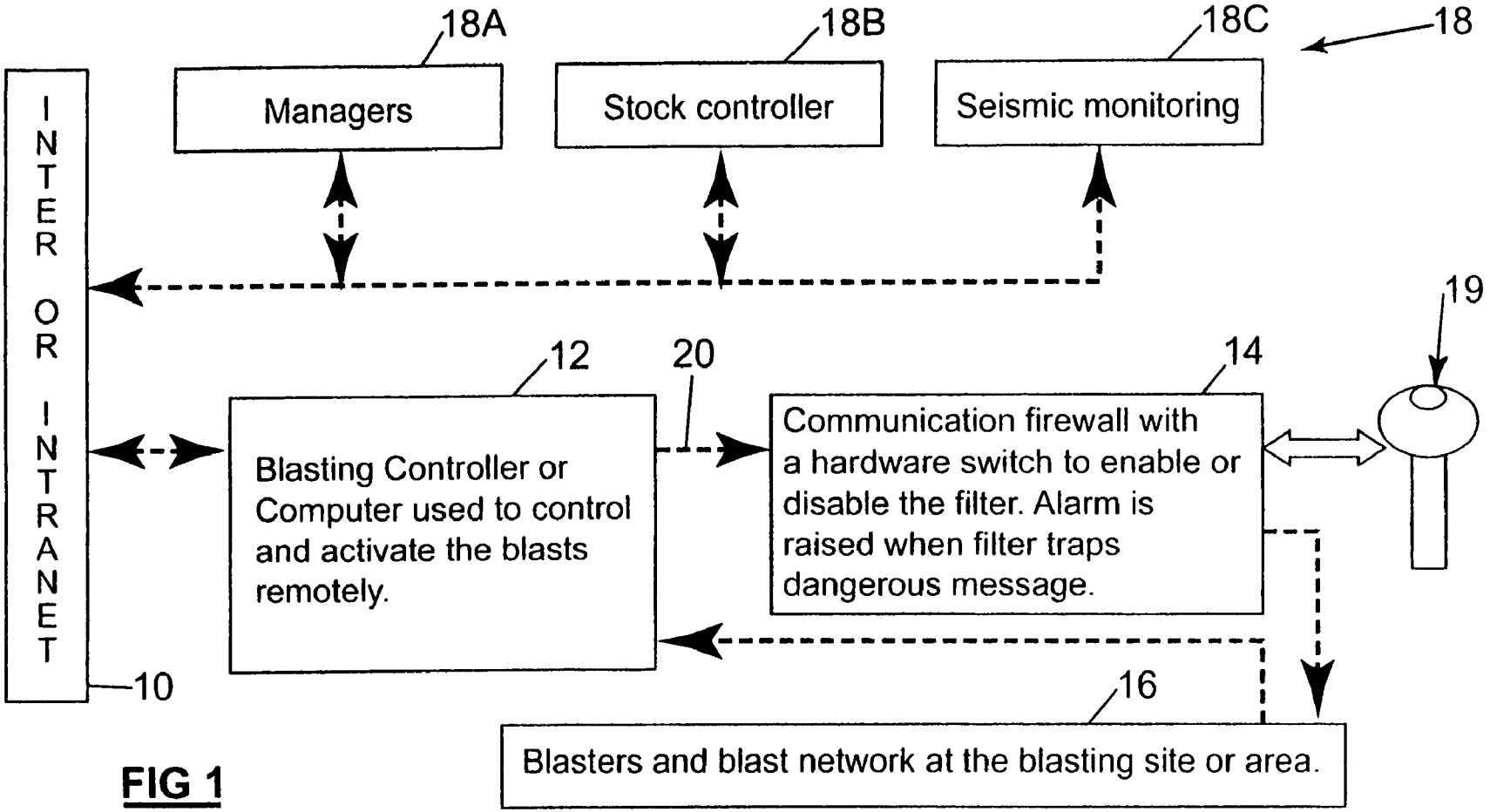
FIG. 1 is a block diagram of an electronic blasting system including one embodiment of a control system according to the invention.

FIG. 1 of the accompanying drawings illustrates in block diagram form a system which allows an Internet or Intranet connection to be made to a blasting network with improved safety.

The system includes an Internet or Intranet facility or connection arrangement 10, a blasting controller or control computer 12 which is used to control and activate blasts remotely, a communication fire wall 14, a blasting network 16, and a variety of interrogating terminals 18.

The blasting controller 12 is used in a known manner and includes a standard device employed to control the network 16 and to activate the initiation thereof, remotely. These aspects are known in the art and hence are not further described herein. Similarly the blasting network 16 consists of an assembly of detonators and communication devices installed in a known manner at a blasting site, making use of known technology.

The communication fire wall includes a locking device 19 for placing a communication link 20, which may be an electrical conductor, to the blasting network in a control mode, or in an operational mode, according to requirement. As used herein the expression "locking device" includes any switchable component or mechanism which allows the fire wall to be made operational, or to be rendered inoperational, according to requirement. The locking device may be operated using a key, by means of an electronic keypad requiring a password, or it may be a remotely activated switch on a private connection. Thus, in a general sense, the locking device may be mechanically or electronically operated.

The remote terminals 18 may vary according to requirement. The terminals may for example provide access, via an Internet connection, to the blasting network for managers 18A, stock controllers 18B, or a seismic monitoring unit 18C. These examples are merely illustrative and are not limiting.

Figure 2:
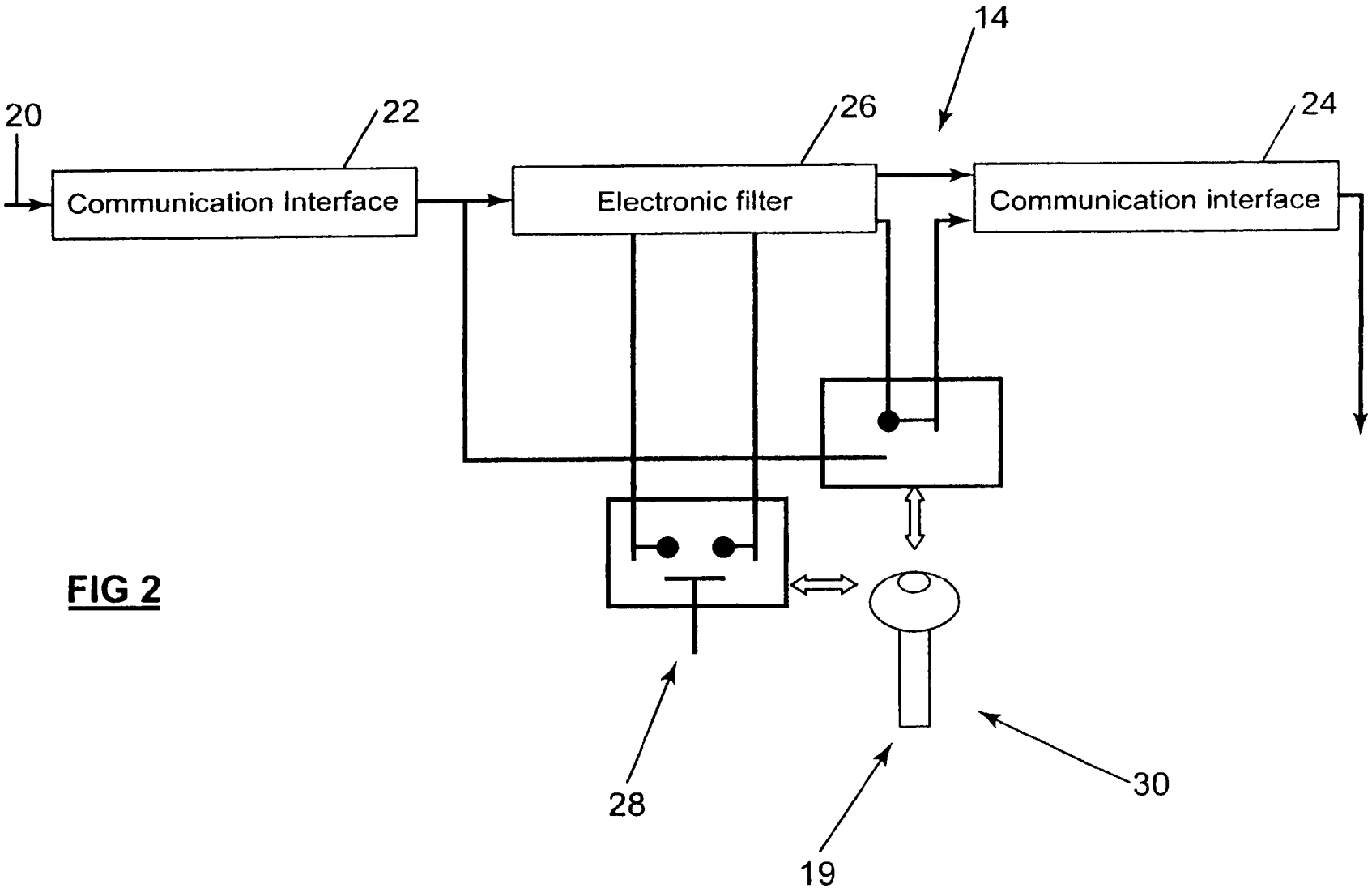
FIG. 2 is a block diagram of a communication fire wall for use in the control system of FIG. 1.

FIG. 2 illustrates further detail of the communication fire wall 14. The communication firewall includes communication interfaces 22 and 24 which allow communication to take place with the communication link 20, an electronic filter 26 and, in this example, a locking device 19 which consists of a mechanical or electronic switch 28 which is activated by means of a mechanical or electronic key 30.

The operation of the electronic filter 26 is described hereinafter with reference to FIG. 3 and a variation of such operation is described with reference to FIG. 4.

As indicated, by connecting the blasting system 16 to the Internet 10 a potential safety risk is introduced due to the possibility being created that hackers can penetrate the system. This risk is eliminated, or at least substantially reduced, by making use of the communication fire wall 14 to selectively filter out unsafe or dangerous commands like "arm", which results in the blasting network being armed, and "fire" which causes the blasting network to be initiated.

It is to be noted that the communication medium and protocols used to communicate between the blast controlling system and the blasting network may be of any appropriate type capable of achieving reliable communication.

The communication interfaces allow the communication to interface with the electronic components incorporated in the filter 26. These electronic components may include a micro controller, programmable logic devices or discrete components. The choice of the electronic components is determined inter alia by the complexity of the communication protocol which is used.

Figure 3:
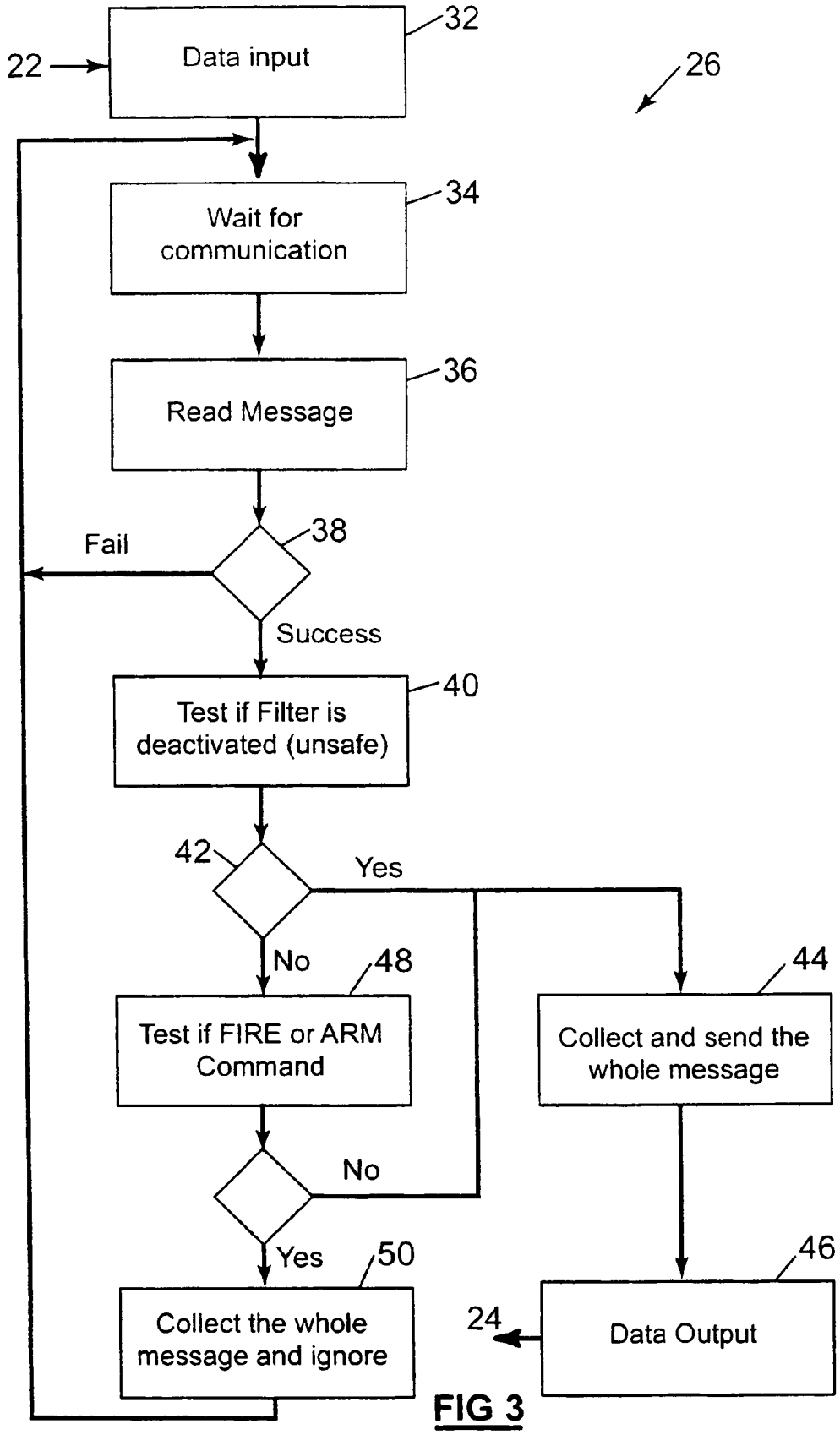
FIG. 3 is a logical flowchart of the operation of a filter, used in the control system of FIG. 1, according to a first form of the control system.

Referring to FIG. 3, data on the link 20 (block 32) is received from the communication interface 22 and is input to the filter 26. The filter waits for communication (34) and reads each message on the line (36). If a message is unsuccessfully read then the system returns to the mode at which it awaits communication.

Once a message is successfully read (block 38) a test is carried out to see if the filter 26 has been deactivated (step 40) to place the communication link 20 in its operational mode. As noted, the filter is deactivated by means of the mechanical key 30. When the filter is deactivated the communication link 20 is capable of transmitting designated unsafe or dangerous messages, such as arm and fire commands, which have been legally generated by means of the blasting computer 12, to the blasting network 16. Thus if the filter has been deactivated (step 42) any message received, regardless of its origin, is collected (block 44) and transmitted via the communication interface 24 as output data (46). The system then reverts to its waiting mode at which further messages are awaited.

On the other hand if the filter 26 is activated so that the communication link is in its control mode, any message received is tested to see whether it is safe or unsafe (step 48). Safe messages are collected and transmitted on the communication link (steps 44 and 46) to the communication interface 24. If a designated unsafe message is detected, it is collected but simply ignored (step 50). The system then reverts to the mode at which it waits for further communication.

If an unsafe or dangerous message is detected with the filter 26 activated then an alarm signal, visual or audible, is generated. A count is also kept of the number of unsafe messages detected.

With the control steps shown in FIG. 3 the logic is such that unsafe messages which are detected when the filter is activated are assumed to be illegally generated and are ignored. Other messages are transmitted to the required destination via the communication interface 24. The system thus possesses the facility for allowing data associated with the blast network to be accessed from the remote points 18. The data may be located at the blasting controller 12 or at the blasting network 16. It is however not possible to transmit a designated unsafe message to the network 16 unless the communication link 20 has been placed in its operational mode, ie. unless the filter 26 has been deactivated.

Figure 4:
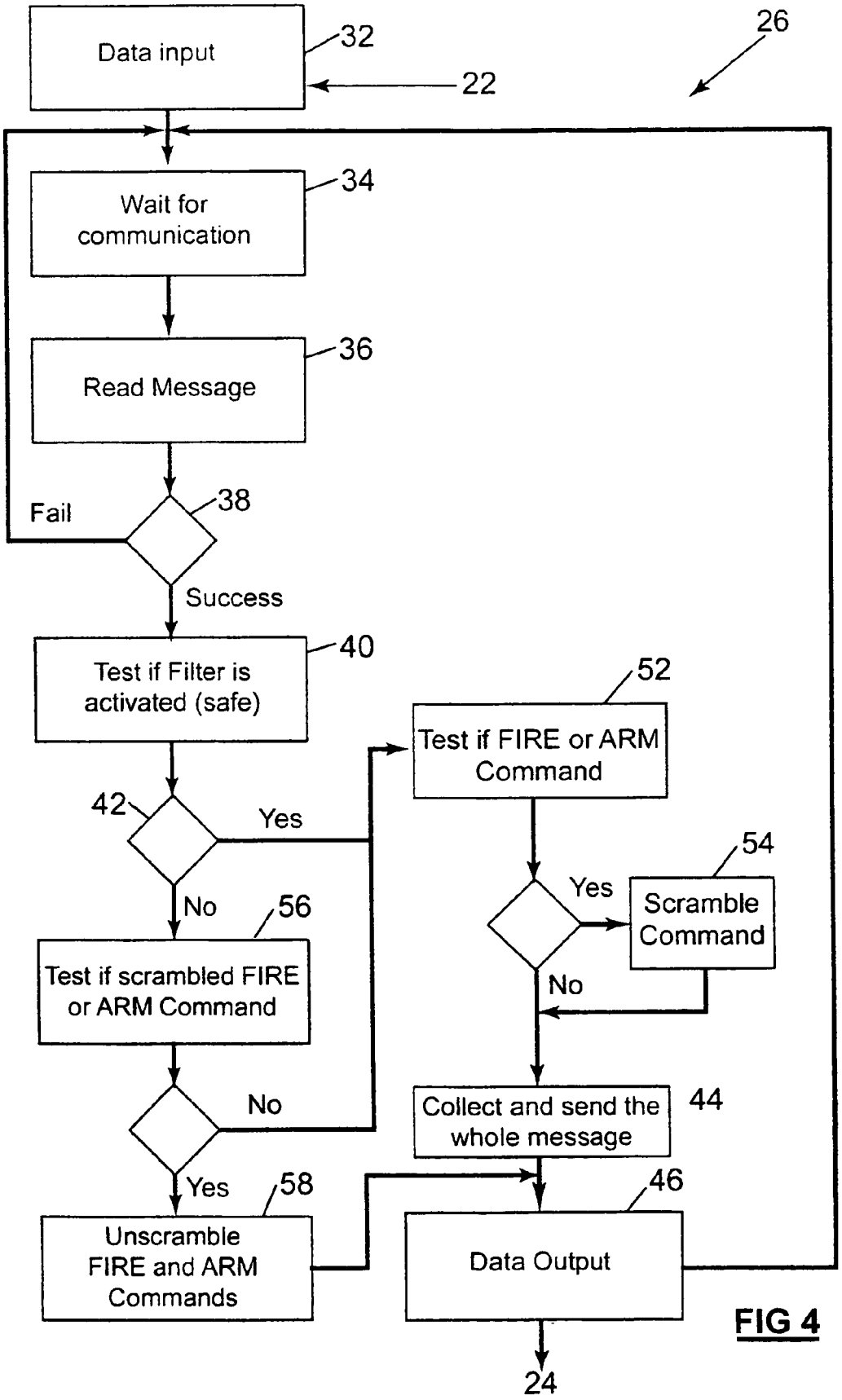
FIG. 4 is a flowchart similar to that shown in FIG. 3 for a variation of the control system.

In the logical sequence shown in FIG. 4 many of the steps are similar or identical to corresponding steps in the sequence shown in FIG. 3 and consequently bear the same reference numerals. The flowchart shown in FIG. 4 is however intended for use with a blasting controller 12 which scrambles designated unsafe messages. Thus, legally generated arm and fire commands, produced by the controller 12, may be transmitted to the blasting network 16 in a scrambled state when the filter 26 is activated, but these scrambled messages will be ignored since they will not be understood by the blasting network as arm and fire commands.

In the step 40 a test is carried out to see if the filter 26 is deactivated (ie the communication link 20 is in its operational mode) or activated (ie the communication link 20 is in its control mode). In the latter case a test is then carried out on the received message to see whether it contains a designated unsafe or dangerous command such as "fire" or "arm" (step 52). If the message is unsafe then, in step 54, the command is scrambled whereafter the scrambled command is collected and transmitted (steps 44 and 46). By scrambling an unsafe message, the unsafe message is converted into a safe message.

On the other hand if the received message is safe then no scrambling takes place and the message is transmitted in an unscrambled form to its destination.

If the filter has not been activated, so that the communication link is in its operational mode, a test is carried out in step 56 to determine whether the received message is a scrambled unsafe message such as a scrambled fire or arm command. A scrambled message is unscrambled (step 58) and is then transmitted to its destination via the communication interface 24. If the message is not a scrambled unsafe message then, in step 52, a test is carried out to see if the message is an unsafe message in unscrambled form. If the test result is affirmative then it is assumed that the message has been illegally generated and, as before, the message is scrambled (step 54) before being transmitted. If the test result is negative then the message is transmitted in the received form to its destination via the communication interface 24.

It follows that the locking device 19 is used to bypass the filter 26 when it is safe to blast. The bypass is achieved by hard wiring the communication around the filter or by the filter sensing the status of the switch and then, based on the status, filtering the dangerous commands out or unscrambling them.

If the filter has sufficient intelligence then it can send the arm and fire commands. It would therefore not be possible for an unauthorised user to initiate a blast. This could only be achieved by deactivating the fire wall via the mechanical or locking device 19.

The control computer 12 may communicate directly with the filter 26. If there is no response from the filter then the control computer will not attempt communication with the blasting network. The filter can thus act as a software dongle. If, as is the case with the FIG. 4 embodiment, dangerous legal messages are scrambled then the filter must be activated for the system to operate.

It is to be noted that normal commands to query the blasting network and to determine the status of components at the blasting site are unaffected. Once the blast area is clear the mechanical or electrical key is used to disable the filtering action and unblock the commands. The arm and fire commands may now be sent through the filter via the blast network to the blasting equipment. The control computer will scramble the dangerous commands. The filter, when unblocked, will correct the scrambled commands. If the filter is deactivated the scrambled dangerous commands will be sent to the blasting network. The blasting network will disregard these commands.

In the FIG. 4 embodiment, an illegally generated unsafe message, that is an unsafe message not generated by the blasting controller 12, would have to have the same scrambled format as a legally generated scrambled unsafe message to initiate blasting once it has been unscrambled.

In the embodiments of the invention described with reference to FIGS. 3 and 4, the filter 26 is activated to place it in the safe or control mode in which unsafe messages can not be transmitted to the blasting network 16 and deactivated to place it in the unsafe or operational mode in which unsafe messages are transmitted. However, it is to be understood that the filter 26 may be one in which the safe or control mode is achieved by deactivating or otherwise switching the filter and the unsafe or operational mode is achieved by activating or otherwise switching the filter. In other words, what is important in this respect is merely that the filter can be switched between control and operational modes.

Those skilled in the art will appreciate that the invention described herein is susceptible to variations and modifications other than those specifically described. It is to be understood that the invention includes all such variations and modifications which fall within its spirit and scope.

What is claimed is:

1. A method of controlling a blasting network including an assembly of detonators, said blasting network being in a blasting system which further includes a control unit, a communication link for transmitting messages between the control unit and the assembly of detonators, said messages consisting of safe and unsafe messages, and a communication firewall comprising a locking device for placing the communication link in a control mode or an operational mode, an electronic filter and two communication interfaces adapted to allow communication to take place with the communication link, said method including the steps of designating at least one message as unsafe, placing the communication link in said control mode, in which the communication link is monitored for the designated at least one unsafe message, in said control mode preventing the designated at least one unsafe message from reaching the assembly of detonators, and placing the communication link in said operational mode, in which the designated at least one unsafe message is allowed to reach the assembly of detonators, and wherein in both the control mode and the operational mode the safe messages are permitted to be transmitted to the assembly of detonators via the communication link.

2. A method according to claim 1 wherein in the control mode of the communication link the or each unsafe message is prevented from reaching the assembly of detonators by preventing the onward transmission of the unsafe message.

3. The method of claim 1 which includes the step of designating at least two unsafe messages.

4. A method according to claim 1 wherein in the control mode of the communication link the or each unsafe message Is prevented from reaching the assembly of detonators by scrambling the or each designated unsafe message so that it is no longer unsafe.

5. A method according to claim 4 which includes, in the operational mode of the communication link, the steps of detecting a scrambled unsafe message, unscrambling the detected scrambled unsafe message, and transmitting the unscrambled unsafe message to the assembly of detonators.

6. A method of controlling a blasting network including an assembly of detonators, said blasting network being in a blasting system which further includes a control unit, a communication link for transmitting messages between the control unit and the assembly of detonators, said messages consisting of safe and unsafe messages, and a communication firewall comprising a locking device for placing the communication link in a control mode or an operational mode, an electronic filter and two communication interfaces adapted to allow communication to take place with the communication link, said method including the steps of designating two messages as unsafe, placing the communication link in said control mode, in which the communication link is monitored for the designated unsafe messages, in said control mode preventing the designated unsafe messages from reaching the assembly of detonators, and placing the communication link in said operational mode, in which the designated unsafe messages are allowed to reach the assembly of detonators, wherein in both the control mode and the operational mode the safe messages are permitted to be transmitted to the assembly of detonators via the communication link, and wherein the two designated unsafe messages are respectively equated with arm and fire commands.

7. A system for controlling a blasting network including an assembly of detonators, said system including a control unit, a communication link for transmitting messages between the control unit and the assembly of detonators, said messages consisting of safe messages and at least one designated unsafe message, and a communication firewall comprising a locking device for placing the communication link in a control mode or an operational mode, an electronic filter and two communication interfaces adapted to allow communication to take place with the communication link, wherein the communication link in its control mode prevents the at least one designated unsafe message from being transmitted to the assembly of detonators and in its operational mode permits the at least one designated unsafe message to be transmitted to the assembly of detonators, and wherein in both its control mode and its operational mode the communication link permits the safe messages to be transmitted to the assembly of detonators via the communication link.

8. A system for controlling a blasting network according to claim 7 wherein in the control mode of the communication link the onward transmission of the at least one designated unsafe message is prevented.

9. A system for controlling a blasting network according to claim 7 wherein the control unit is capable of generating legal unsafe messages, which are transmitted via the communication link in its operational mode.

10. A system for controlling a blasting network according to claim 7 wherein the locking device is a switch.

11. A blasting system including a system for controlling a blasting network according to claim 7 connected to a blasting network including an assembly of detonators.

12. A blasting system according to claim 11 wherein the control unit of the system for controlling a blasting network is capable of generating legal unsafe messages, which are transmitted via the communication link in its operational mode.

13. A blasting system according to claim 11 wherein the locking device is a switch.

14. A system for controlling a blasting network according to claim 7 wherein the at least one designated unsafe message, when detected, is scrambled.

15. A system for controlling a blasting network according to claim 14 wherein in the operational mode of the communication link the scrambled at least one designated unsafe message is detected and unscrambled for transmission of the unscrambled at least one designated unsafe message to the assembly of detonators.

16. A method of controlling a blasting network including an assembly of detonators, said blasting network being in a blasting system which further includes a control unit and a communication link for transmitting messages between the control unit, the assembly of detonators, said messages consisting of safe and unsafe messages, and a communication firewall comprising a locking device for placing the communication link in a control mode or an operational mode, an electronic filter and two communication interfaces adapted to allow communication to take place with the communication link, said method including the steps of designating at least one message as unsafe, placing the communication link in said control mode, in which the communication link is monitored for the designated at least one unsafe message, in said control mode preventing the designated at least one unsafe message from reaching the assembly of detonators, and placing the communication link in said operational mode, in which the designated at least one unsafe message is allowed to reach the assembly of detonators, and wherein in both the control mode and the operational mode the safe messages are permitted to be transmitted to the assembly of detonators via the communication link, wherein the control unit is connected to an Internet or Intranet facility or connection arrangement.

17. A system for controlling a blasting network including an assembly of detonators, said system including a control unit, the control unit being connected to an Internet or Intranet facility or connection arrangement, a communication link for transmitting messages between the control unit and the assembly of detonators, said messages consisting of safe messages and at least one designated unsafe message, and a communication firewall comprising a locking device for placing the communication link in a control mode or an operational mode, an electronic filter and two communication interfaces adapted to allow communication to take place with the communication link, wherein the communication link in its control mode prevents the at least one designated unsafe message from being transmitted to the assembly of detonators and in its operational mode permits the at least one designated unsafe message to be transmitted to the assembly of detonators, and wherein in both its control mode and its operational mode the communication link permits the safe messages to be transmitted to the assembly of detonators via the communication link.

18. A blasting system including a system for controlling a blasting network according to claim 17 connected to a blasting network including an assembly of detonators.

* * * * *